356-400 SR
8/20/85 XR 4,535,699

United States Patent [19]
Bühler

[11] Patent Number: 4,535,699
[45] Date of Patent: Aug. 20, 1985

[54] DEVICE FOR CONTROLLING A RAILROAD TRACK MAKING OR REPAIRING MACHINE

[75] Inventor: Fritz Bühler, Ecublens, Switzerland

[73] Assignee: Les Fils D'Auguste Scheuchzer S.A., Switzerland

[21] Appl. No.: 414,805

[22] Filed: Sep. 3, 1982

[30] Foreign Application Priority Data

Mar. 31, 1982 [EP] European Pat. Off. ..... 82200403.2

[51] Int. Cl.³ ..... E01B 35/08; E01B 35/10
[52] U.S. Cl. ..... 104/7 B; 33/287; 73/146; 356/400
[58] Field of Search ..... 33/287, DIG. 21; 73/146; 104/7 R, 7 A, 7 B; 356/138, 153, 399, 400

[56] References Cited

U.S. PATENT DOCUMENTS

| | | | |
|---|---|---|---|
| 3,469,534 | 9/1969 | Plasser et al. | 104/7 B |
| 3,494,297 | 2/1970 | Plasser et al. | 104/7 B |
| 3,545,384 | 12/1970 | Plasser et al. | 104/7 B |
| 3,750,299 | 8/1973 | Plasser et al. | 104/7 R X |
| 3,821,932 | 7/1974 | Theurer et al. | 104/7 B |
| 4,166,291 | 8/1979 | Shupe | 104/7 B |
| 4,173,073 | 11/1979 | Fukazawa et al. | 104/7 B X |
| 4,356,771 | 11/1982 | Theurer | 104/7 B |

*Primary Examiner*—Robert B. Reeves
*Assistant Examiner*—David F. Hubbuch
*Attorney, Agent, or Firm*—Kane, Dalsimer, Kane, Sullivan and Kurucz

[57] ABSTRACT

This device for controlling a railroad track making or repairing machine comprises on the one hand a single laser emitter mounted on a skip standing on the track or the lay-out ahead of the machine, notably a tamping, levelling and lining machine, emits a first fan-shaped or sweeping beam in a horizontal plane and a second fan-shaped or sweeping beam in a vertical plane, and on the other hand two laser receivers mounted on the machine and adapted to adjust themselves automatically as a function of the impact line of one or the other of said laser beams at positions corresponding to the desired positions of the working members of the machine, the laser emitter being mounted on a support permitting its rotation about its track-parallel axis between two end positions spaced 90 degrees apart, these angular positions corresponding the one to the beam in the horizontal plane for levelling operations and the other to the beam in the vertical plane for shifting operations. In a modified version the laser emitter is fixedly mounted and it is only the optical system generating the fan-shaped or sweeping beam that is rotated through 90 degrees by means of a motor.

13 Claims, 11 Drawing Figures

DEVICE FOR CONTROLLING A RAILROAD TRACK MAKING OR REPAIRING MACHINE

BACKGROUND OF THE INVENTION

The present invention relates to a device for controlling a railroad track making or repairing machine, which comprises on the one hand a laser emitter mounted on a skip standing on the track or the lay-out thereof ahead of the machine, and adapted to emit a first fan-shaped or sweeping beam in a horizontal plane and a second fan-shaped or sweeping beam in a vertical plane, and on the other hand a laser receiving unit mounted on the machine and comprising a first receiver for the horizontal beam and a second receiver for the vertical beam, both receivers being designed for automatic adjustment as a function of the impact line of one or the other of said laser beams at positions corresponding to the desired positions of the working members of the machine.

Relative-base measuring units have already been used for performing track levelling and lining works, and mounted notably on tamper-leveller-liners.

A known feature of relative-base measuring units of this type is that they reduce appreciably track defects in both horizontal and vertical planes as a function of their geometry in a proportion ranging from 1:3 to 1:4. Another feature inherent to those units is their capacity of reducing the geometric defects of railroad tracks when their wavelengths are less than 20 m. On the other hand, to correct track defects when the wavelength is above 20 m. the use of a longer measurement base consisting either of an optical system or of a laser system becomes necessary.

Existing laser systems comprise emitters generating fan-shaped or sweeping beams either horizontally for levelling operations or vertically for shifting operations. Laser emitters equipped with special optical systems generate horizontal and vertical beams either on the same axis or shifted parallel thereto by means of mirrors. However, this arrangement is objectionable in that one fraction of the laser power out-put is lost in the optical system at the expense of precision and of a reduction in the actual working length. Superposed beams can only be used for alignment purposes since the curves of the two receivers do not follow the same path. Besides, if two separate laser emitters are used, the vertical beam (for shifting or lining) will inevitably intersect at one time the working field of the horizontal beam for the levelling function, thus rendering the complete system inoperative.

SUMMARY OF THE INVENTION

It is the primary object of the present invention to avoid this drawback by providing a device characterized by the fact that the laser emitter system consists of a single laser emitter of which at least one section controlling the beam orientation is rotatably mounted and therefore adapted to rotate about the track-parallel laser axis, and that a motor is provided for rotating said section between two end positions spaced 90 degrees apart from each other, a first position corresponding to the beam operation in the horizontal plane, the second position corresponding to the beam operation in the vertical plane.

Thus, shifting operations and levelling operations can both be carried out by using a single laser emitter generating a fan-shaped or sweeping beam adapted to operate by turns in the horizontal plane and in the vertical plane for levelling and shifting, respectively.

According to a first form of embodiment of the invention the complete laser emitter is mounted to a support permitting the rotation of the laser emitter about its track-parallel axis.

In a second form of embodiment of the invention the laser emitter is mounted in a fixed position and only the optical system directing the fan-shaped or sweeping beam is rotated through 90 degrees by means of a motor.

In many cases, known track repairing machines, especially tamping, levelling and lining machines, are provided with relative measurement bases for levelling and shifting operations. In this case, the laser receivers of the present invention are connected to the relative measurement base for shifting or levelling works, respectively, notably at the front end of the relevant base, the receiver and the relevant base moving together during the automatic adjustment of the receiver.

Moreover and preferably, the device of this invention comprises computer means for calculating the versed sine or rise of curved horizontal and possibly vertical track sections as a function of the distance covered by the machine. This computer is adapted to correct the desired positions of the working members of the machine, respectively the positions of said relative measurement bases with respect to the corresponding laser receiver. Of course, this computer may be dispensed with and the rise may be corrected manually.

For example, in the specific case of a tamping, levelling and lining machine, this laser emitter control device may be so designed that at each tie firstly the horizontal beam is utilized for levelling purposes, whereafter the emitter is rotated through 90 degrees about its track-parallel axis for lining or shifting purposes, or vice-versa. It is also possible to provide control means such that the levelling operation is accomplished every other tie while the shifting operation is carried out on the intermediate ties. With this procedure, the efficiency is increased without impairing the precision, due to the relative bases which reduce any defects possibly remaining between successive ties.

In the following disclosure the invention will be described more in detail with reference to the accompanying drawings.

THE DRAWINGS

FIG. 1 is a diagrammatical side elevational view showing the laser emitter with the receiver for levelling works, the dash-and-dot line corresponding to the horizontal beam and the dash line to the vertical beam.

FIG. 2 similar to FIG. 1 is a plan view from above showing the receiver for shifting or lining operations, the vertical beam being shown in dash-and-dot lines and the horizontal beam in dash lines.

DESCRIPTION OF THE PREFERRED EMBODIMENT

As illustrated diagrammatically in FIGS. 1–9 of the drawings the principle on which the present invention is based consists in providing a single laser emitter 1 disposed ahead of a railroad track making or repairing machine travelling in the direction of the arrow (FIG. 1) and shown diagrammatically in the form of a chassis 2. This emitter 1 is capable of emitting a fan-shaped or sweeping beam directed either horizontally for levelling operations (beam Fn) or, after a 90 degree rotation, vertically, for shifting or lining operations (beam Fr), a levelling receiver Rn and a shifting receiver Rr being both mounted on the same machine.

Figure 1:
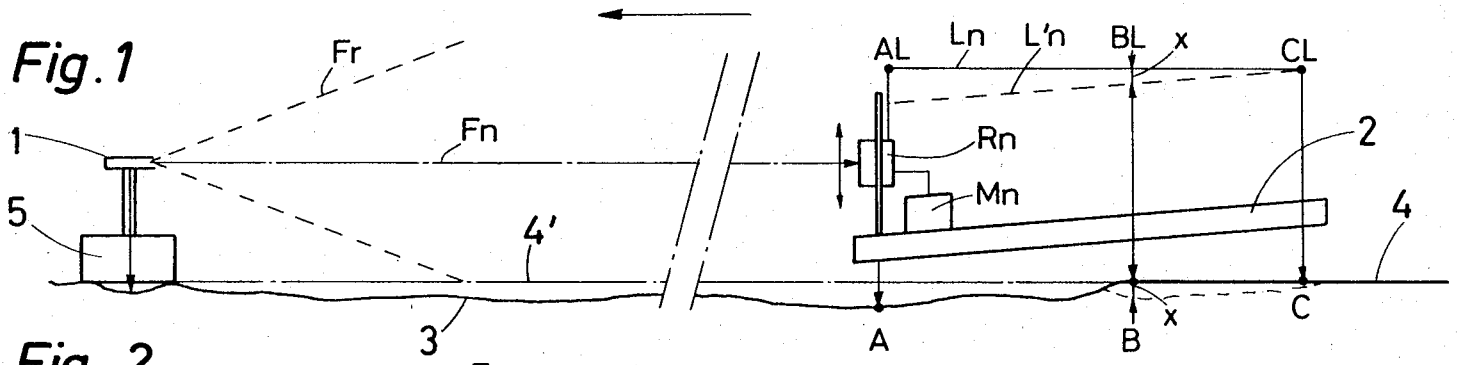

In FIG. 1 showing a side elevational view of the device controlling the levelling operation, the irregular line 3 illustrates the old track to be corrected; however, to facilitate the understanding of this Figure the defects of the railroad tracks have been exaggerated considerably. The dash lines on the right side of the Figure illustrate the freshly corrected track section, line 4 showing the new track as corrected; finally, chain line 4′ illustrates the desired track defined by the laser axis which, during the initial phase of the operation, is set parallel to this desired track.

The device comprises a laser emitter 1 adapted to emit a horizontal beam Fn. This emitter is mounted on a skip 5 disposed at a fixed location suitably selected along the old track 3, ahead of the machine which, in this specific example, is a tamping, levelling and shifting machine shown diagrammatically as comprising the chassis structure 2 and simply designated in the following disclosure by the term "machine". This machine is provided with a known relative measurement base, for example a probe, at each one of the track points A,B,C. Point C lies on the already corrected track section 4, point A lies on the old track 3, and point B is the working point lying therefore in the vicinity of the working members intended for positioning the track and consisting in the known fashion of shifting and levelling clamps. In the example illustrated in FIG. 1 the position of point A is somewhat exaggerated and point B has just been corrected, like point C, and the machine with its chassis 2 is inclined forwards and downwards.

At point A is a laser receiver Rn for levelling operations which is adapted to be set vertically in relation to the chassis 2 by means of an adjustment motor Mn. Secured to this receiver Rn is a member supporting the front end AL of the reference line Ln of the relative measurement base for levelling operations. This end AL overlies point A. In this case, the reference line Ln is assumed to consist of a taught wire stretched above the machine, with one end fastened at point CL disposed vertically above point C and at point BL above point B, for controlling in a manner known per se, through its position and by means of suitable drive means, the position of the levelling clamps.

The levelling laser receiver Rn, like the shifting laser receiver Rr to be discussed presently, comprises four photoelectric cells C1,C2,C3 and C4 (FIG. 3) and is so designed that it can be moved to the desired position by means of an adjustment motor Mn as a function of the line of impact of the horizontal laser beam Fn with respect to said cells, the adjustment taking place when the beam lies exactly between the two central cells C2 and C3.

In the example shown in FIG. 1, this adjustment has already been made in such a way that the reference line Ln which, before the correction, was in the position designated by line L′n, is now in the proper position, that is, parallel to the laser axis Ln. In other words, point BL was corrected vertically by the difference x corresponding exactly to the vertical correction x to the working point B representing the vertical distance through which the track was raised by means of the clamps to the desired position. Under these conditions, BC is corrected track section and AB the uncorrected track section.

Of course, this reference line Ln may consist of any other mechanical or non-mechanical means, for example a light ray, and the aforesaid points A and C are not compulsorily located on the chassis 2 since they may be disposed on small auxiliary skips rolling at a fixed distance ahead or behind the chassis 2.

In actual practice, when operating on a track section comprising not too many curves, the skip 5 supporting the laser emitter 1 may be disposed initially at a distance of about 300 m from the machine and when, during the track repairing works, the machine is too close to the emitter the skip 5 is moved again to a position spaced about 300 m from the machine. Of course, when operating on hilly or undulated grounds, care must be taken that no obstacle exists between the emitter and the receiver.

Figure 2:
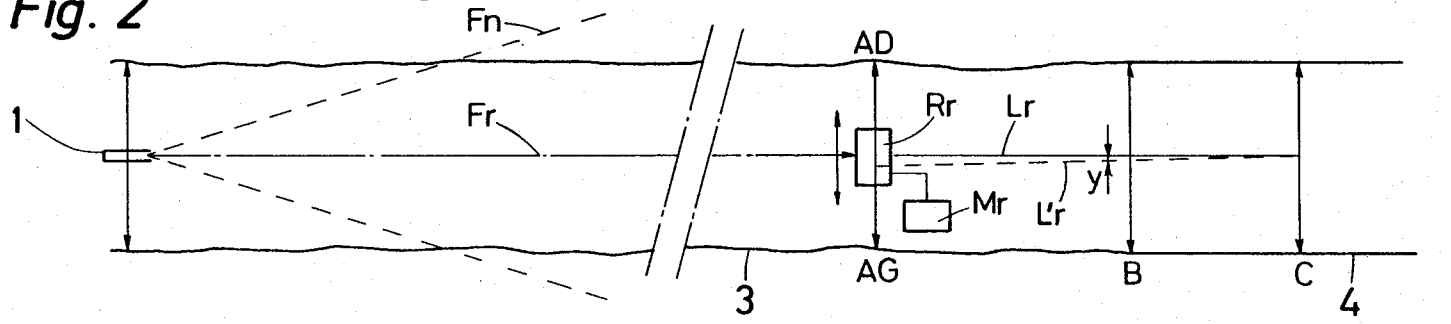
Figure 3:
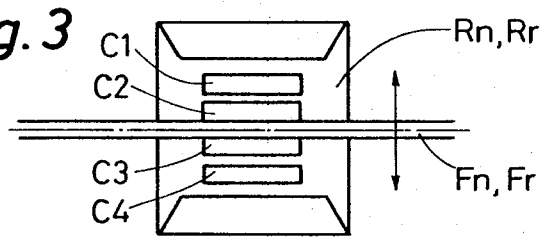
FIG. 3 is a diagrammatic view showing the laser receiver either for shifting or for levelling, with the laser beam adjusted in position.

FIG. 2 illustrates in a manner similar to FIG. 1 a top view of the shifting control device operating in conjunction with a vertical laser beam Fr. The chassis-mounted shifting receiver Rr is adjustable in relation to the chassis proper by means of transverse guide member as a function of the vertical beam Fr under the control of a motor Mr. A reference line Lr is connected to this receiver Rr and the reference line L′r in its uncorrected state is shown in dash line by way of example. It will thus be seen that in this example, at point B corresponding to the shifting clamps, the difference due to the previously made correction is denoted by the distance y. In FIG. 2 it will also be seen that the position A of the reference point comprises the two points AG on the left-hand rail and AD on the right-hand rail.

Figure 4:
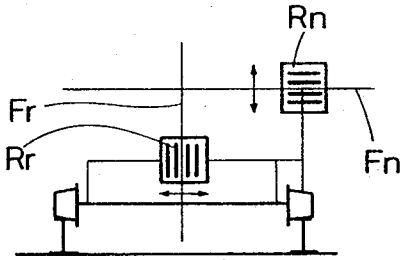
FIG. 4 is a diagrammatic cross-sectional view showing the track with the levelling and shifting laser receivers.

FIG. 4 illustrates diagrammatically a cross-sectional view of the track at the location of the levelling and shifting receivers Rn and Rr, respectively, which shows their relative positions and in this specific case it is assumed that the shifting receiver Rr is coincident with the track axis, the levelling receiver Rn being positioned on the directing line which as a rule is the lowermost rail in a curve.

In order to simplify the drawing in FIGS. 1 to 4, the device for correcting the reference line as a function of the horizontal or vertical versed sine, height or rise of the arc in relation to the receiver has been omitted from these Figures. Therefore, in fact the coupling between the receivers and the reference line is not a perfectly rigid one, since it remains fixed and constant during the adjustment as a function of the laser, and yet can be corrected as a function of the measurement of the versed sine or rise, as will be explained presently with reference to FIG. 6.

Figure 5:
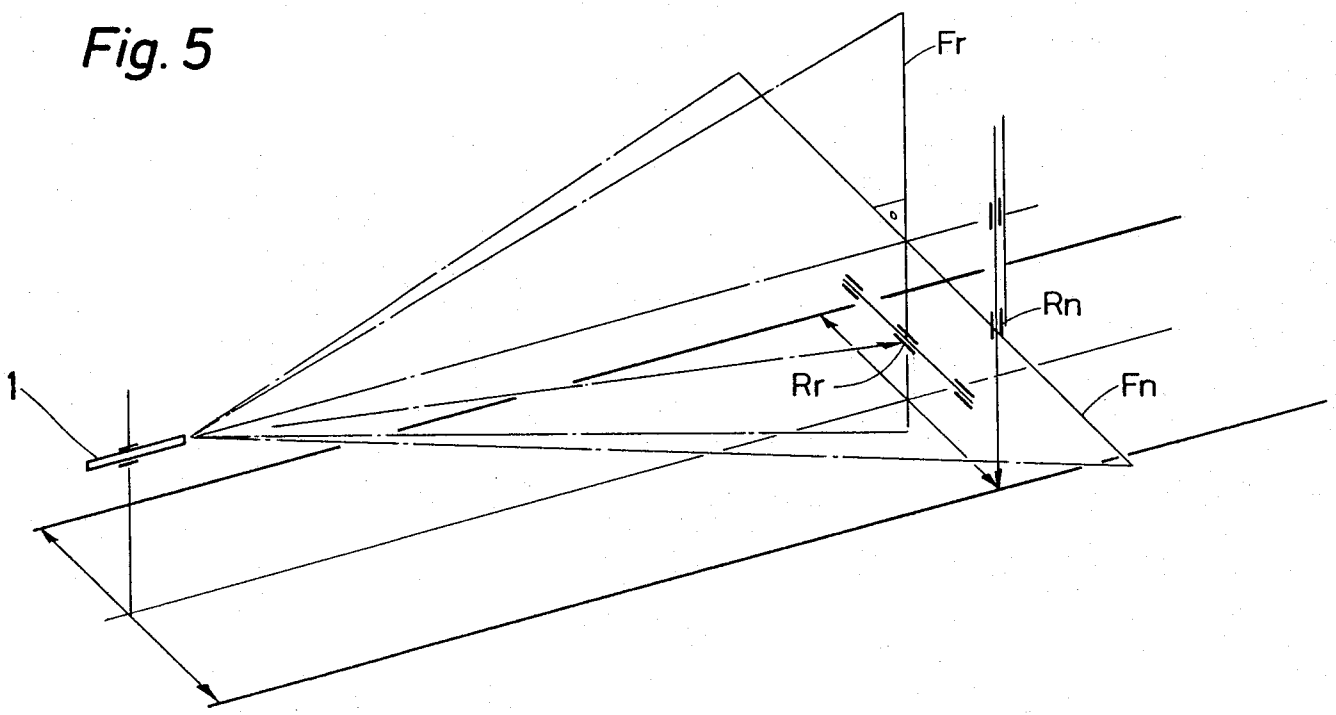
FIG. 5 is a diagrammatic perspective view showing the basic principle of the device with the two beams and the two receivers.

FIG. 5 illustrates simultaneously the two systems in perspective and it will be seen that the horizontal beam Fn and vertical beam Fr, together with the two receivers, namely the levelling receiver Rn adapted to travel vertically and the shifting receiver Rr adapted to move horizontally. The laser emitter 1 is positioned on the track axis.

Figure 6:
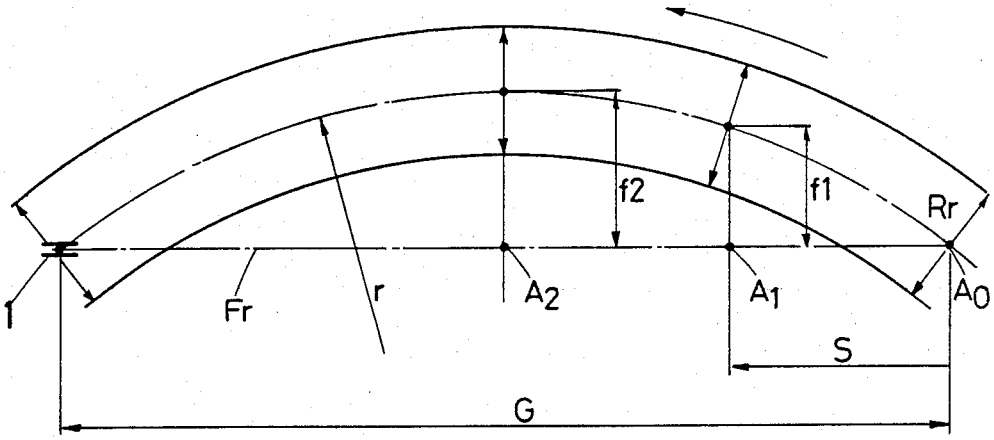
FIG. 6 illustrates diagrammatically the same device disposed on a curved track section.

FIG. 6 shows the mode of operation of the shifting system in a curved track section having a radius r. Initially, the laser beam Fr generates a chord between the emitter 1 disposed ahead of the machine and the shifting receiver Rr supported by the machine. In the initial position, the receiver Rr and the reference line are at point Ao on the median line of the track. During the operation, if the machine is moved in the direction of the arrow S, it follows the track curvature while the shifting receiver follows the vertical beam Fr of the laser along the chord having a length G, the movement of this receiver depending on the versed sine of the arc externally of the median line. Thus, for example, if this receiver is at point A1, it has covered the distance corresponding to the versed sine or rise f1. Of course, in this case the relative measurement base, respectively the reference line, must not follow the receiver since this line determines the position of the working clamps at point B; therefore, the rise f1 is calculated as a function of the curve, and the reference line is shifted by a distance f1 in relation to the receiver externally of the curve. Similarly, when the laser receiver Rr is at point A2, the reference line is moved to the extent corresponding to the versed sine or rise of arc f2, which is the distance between the position of receiver Rr adjusted on the beam and the reference line determining the position of the working members on the desired curve.

Figure 7:
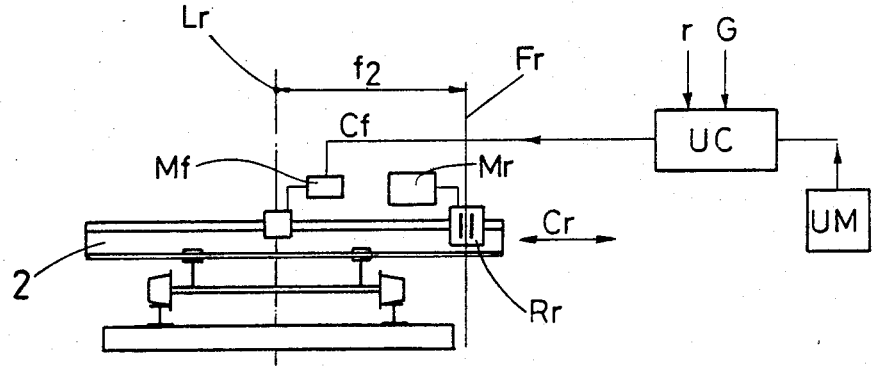
FIG. 7 is a diagrammatic cross sectional view showing the track, the overlying receiver for a shifting operation, and the means for calculating the versed sine or rise of the curve.

FIG. 7 further illustrates in diagrammatic cross section the track at the above-defined point A2. The receiver Rr has covered a distance f2 externally of the median line, but on the other hand the front end of reference line Lr (extending at right angles to the plane of the Figure) must also be moved through this distance f2 to the desire position, i.e. the centre of the track. Consequently, the front end of reference line Lr is also movable in a transverse direction with respect to receiver Rr. Whereas in FIG. 2 showing a straight track section the end of reference line Lr is disposed centrally of receiver Rr, in the example of FIG. 7 the end of this line Lr is shifted by the distance or rise f2 by means of a motor Mf supported by the chassis 2. To calculate the rises or versed sines f1,f2 . . . fn as the machine is travelling in the forward direction, a rise computer UC and an apparatus UM for calculating the distance covered by the machine are used. The computer UC calculates the rise f in a known fashion as a function of the radius r of the curve and the length G of the chord, and actuates a positioning motor Mf adapted to move the support of reference line Lr according to the calculated value in order to correct the rise Cf, while the position of receiver Rr is controlled by the vertical beam Fr by means of a motor Mr to correct the shifting Cr.

Figure 9:
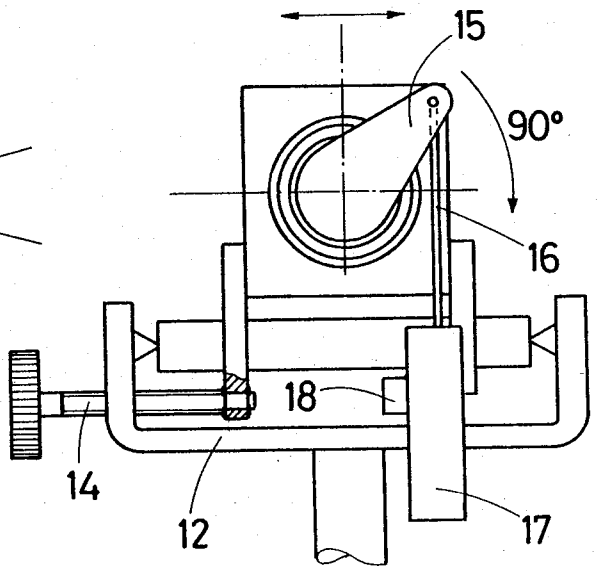
FIG. 9 is another simplified end view of the laser emitter with the drive motor.
Figure 8:
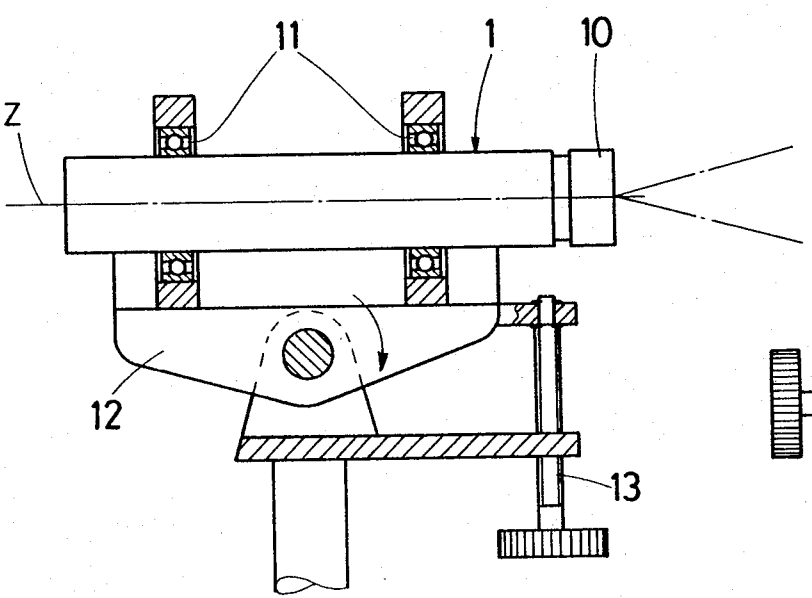
FIG. 8 is a simplified side elevational view of the laser emitter.

A typical laser emitter suitable for operating with the above-described device is illustrated in FIGS. 8 and 9 of the drawings. This laser emitter 1 is of conventional type and comprises at the front an optical system 10 for generating a fan-shaped or sweeping beam, consisting of at least one lens element or an oscillating deflection mirror. The laser emitter 1 with its fan-shaped or sweeping system is mounted in ballbearings 11 for rotation about its central axis Z parallel to the track. The assembly is carried by a support 12 adapted to be adjusted both vertically and horizontally by means of adjustment screws 13 and 14, respectively. The laser emitter is further connected through an arm 15 (FIG. 9) to one end of a rod 16 adapted to be actuated by a motor 17, preferably an electric motor, for rotating the emitter 1 through an angle of 90 degrees about its axis 2 according as the beam is to be vertical or horizontal.

According to a preferred form of embodiment, this motor 17 is associated with a radio receiver 18 for controlling the motor from the machine.

In another form of embodiment of the invention the laser emitter proper is mounted in a fixed position and only the optical device generating the fan-shaped or sweeping beam is rotatably mounted so that it can swivel about the laser axis under the control of a suitable motor.

Figure 10:
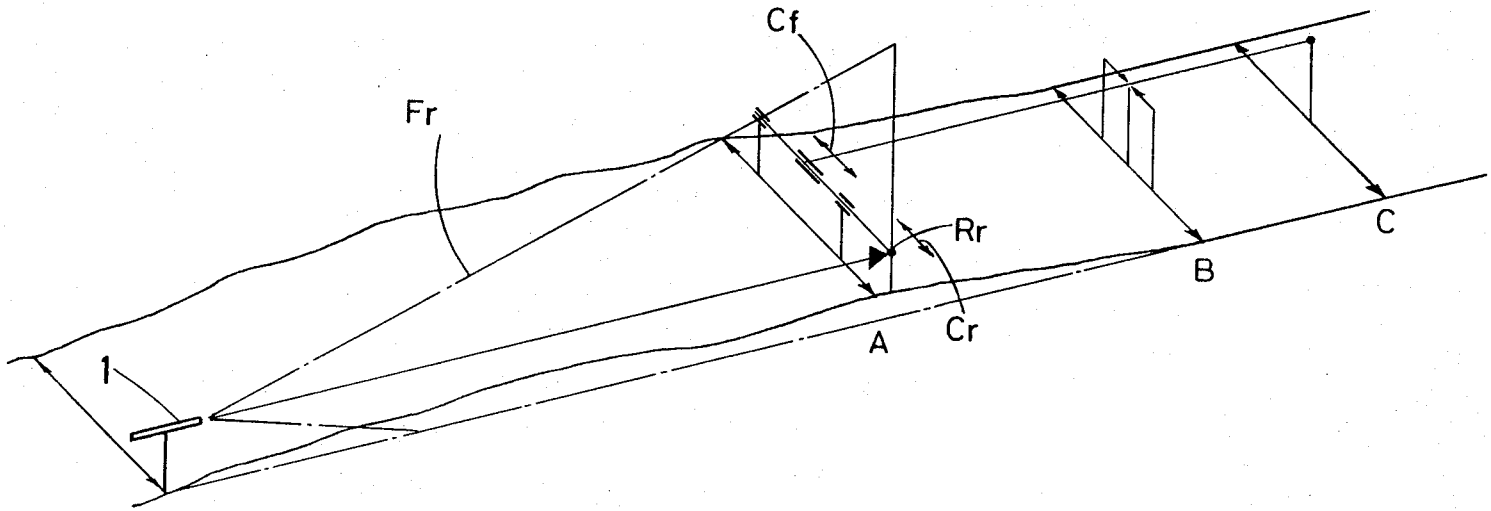
FIG. 10 illustrates diagrammatically a typical form of embodiment wherein the laser emitter and the shifting receiver are disposed on the directing line.

FIG. 10 is a diagrammatic perspective view illustrating a modified method of utilizing the device of the invention. In this case, the laser emitter 1 generating the vertical beam Fr is disposed on the directing line and the shifting receiver Rr is disposed likewise on the directing line. In this specific example the correction of shifting Cr and the correction of rise Cf are also shown diagrammatically.

Figure 11:
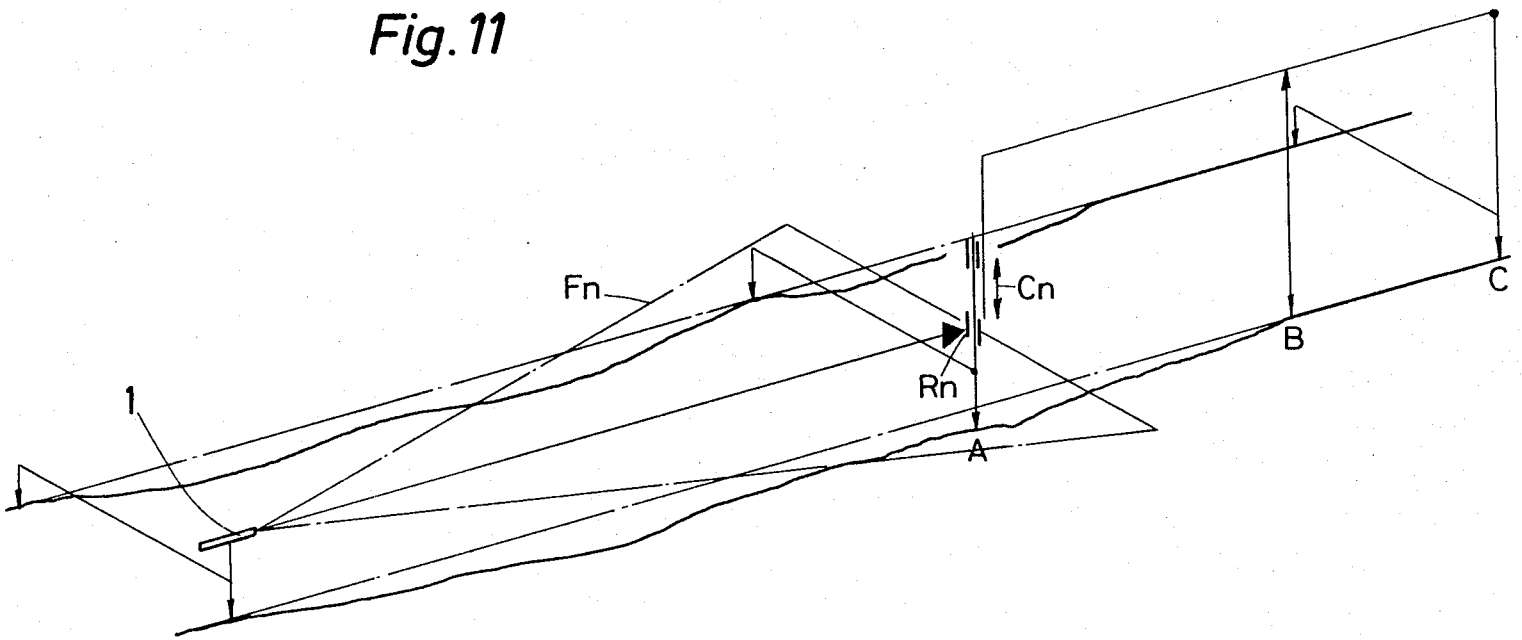
FIG. 11 is a diagrammatic perspective view showing the laser emitter and the levelling receiver disposed on the directing line.

A modified mode of operation of the device is also shown in FIG. 11, wherein the laser emitter 1 generating the horizontal beam Fn and the laser levelling receiver Rn are both disposed on the directing line. The levelling correction Cn shown also diagrammatically may if desired be completed with a vertical rise correction, in the case of a track section having a vertical curvature.

The above-described control device may be used in actual practice in any of the two following ways:

The track is levelled and shifted at each tie; in other words, at each tie for example firstly the track is levelled by operating with the horizontal laser beam, and then the shifting operation is carried out after rotating the laser emitter through 90 degrees for operating with the vertical beam;

The track is levelled only every other tie, and shifted at each intermediate tie.

Of course, the invention should not be construed as being strictly limited by the specific form of embodiment described and illustrated herein, since it is also possible to operate without any relative measurement base. In this case, the working members or clamps are controlled directly by the levelling receiver or the shifting receiver, respectively.

Moreover, this device comprising only one laser emitter is applicable to any other railroad track repairing machine, for example a ballast-clearing machine, a track relaying train or a train for laying new tracks.

What is claimed is:

1. A device for controlling a railroad track making and repairing machine having working members for levelling, tamping and shifting a track in accordance with a first and second relative reference base, comprising:

a laser emitter system mounted ahead of said machine and having a laser adapted to emit a planar beam, along a predetermined axis parallel to said track, and means for rotating said beam around said axis between a first position in which said planar beam is horizontal and a second position in which the said planar beam is vertical; and a laser beam receiving system mounted on said machine and consisting of a first receiver arranged and constructed to intercept said beam when said beam is horizontal, said first receiver being adapted to shift vertically until said planar beam impacts said first receiver at a first preselected point, said first receiver being operatively connected to orient said first relative base, and second receiver means arranged and constructed to intercept said planar beam when said beam is vertical, said second receiver being adapted to shift horizontally until said planar beam impacts said second receiver at a second preselected point, said second receiver being operatively connected to orient the second relative base.

2. The device of claim 1 wherein said laser is adapted to emit said planar beam by beam sweeping.

3. The device of claim 1 wherein said laser is adapted to emit a fan-shaped beam.

4. The device of claim 1 wherein said means for rotating said beam comprises a support means for supporting said laser emitter system, said support means being adapted to rotate said system about said predetermined axis.

5. The device of claim 1 wherein said laser emitter system has an optical system and a motor operatively connected to said optical system for rotating said beam between said two positions.

6. The device of claim 1, which further comprises a computer for calculating the versed sine of the horizontally or possibly vertically curved track sections as a function of the distance covered by the machine, the desired positions of said working members are corrected in relation to the corresponding receiver by said versed sine computer.

7. The device of claim 1 wherein said track has a track axis and said track is laid along a directing line, wherein said laser emitter is disposed on one of the track axis and directing line.

8. The device of claim 7 wherein said first and second receivers are disposed on one of said track axis and directing line.

9. The device of claim 7 wherein one of said first and second receivers is disposed on said track axis and the other of said first and second receivers is disposed on the and directing line.

10. The device of claim 1 wherein said means for rotating said beam comprises a motor for rotating said beam between said first and second positions and a radio receiver operatively connected to said motor to control said motor by remote control means.

11. A method for levelling, shifting and tamping a railroad track comprising:

providing a machine adapted to level, shift and to tamp the railroad track in accordance with a first relative reference base and a second relative reference base perpendicular to said first reference base;

providing a laser assembly adapted to generate a planar beam along a predetermined axis, said laser assembly further being adapted to emit said planar beam selectively along a horizontal or vertical plane by rotating said beam between a first and second positions;

providing a first receiver mounted on said machine and adapted to orient said first relative reference base when a planar beam is intercepted at a first point, said first receiver being adapted to move vertically with respect to said machine, and and a second receiver mounted on said machine and adapted to orient said first relative reference base when a planar beam is intercepted at a second point, said second receiver being adapted to move horizontally with respect to said machine;

positioning said laser assembly ahead of said machine with said preselected axis in parallel with said track;

directing said planar beam along one of said horizontal and vertical planes at the corresponding receiver; and rotating said planar beam to direct along the other of said horizontal and vertical planes.

12. The method of claim 11 wherein said planar beam is rotated at every track tie.

13. The method of claim 11 wherein said planar beam is directed along alternate planes at alternate track ties.

* * * * *